United States Patent [19]

Clark et al.

[11] Patent Number: 4,659,288

[45] Date of Patent: Apr. 21, 1987

[54] DUAL ALLOY RADIAL TURBINE ROTOR WITH HUB MATERIAL EXPOSED IN SADDLE REGIONS OF BLADE RING

[75] Inventors: Jeffrey Clark; David Finger, both of Tempe; Ron Vanover, Phoenix, all of Ariz.; Mike Egan, Milford, Mich.

[73] Assignee: The Garrett Corporation, Los Angeles, Calif.

[21] Appl. No.: 680,216

[22] Filed: Dec. 10, 1984

[51] Int. Cl.[4] ..... F01D 5/14

[52] U.S. Cl. ..... 416/186 R; 416/188; 416/213 R; 416/241 R; 416/244 A; 29/156.8 R

[58] Field of Search ..... 29/23.5, 156.4 R, 156.8 R, 29/156.8 B, 156.8 CF; 416/181-183, 185, 186 R, 188, 193 A, 204 A, 224, 213 R, 228, 229 A, 234, 241 R, 244 R, 244 A, 248; 415/212 R

[56] References Cited

U.S. PATENT DOCUMENTS

| | | | |
|---|---|---|---|
| 2,174,380 | 9/1939 | Doran | 29/156.8 R |
| 2,429,324 | 10/1947 | Meisser | 29/23.5 X |
| 2,585,973 | 2/1952 | Stieglitz | 29/156.8 R X |
| 2,888,244 | 5/1959 | Pekarek | 416/241 R |
| 2,922,619 | 1/1960 | Slemmons | 416/244 R |
| 3,124,452 | 3/1964 | Kraft | 148/404 |
| 3,342,455 | 9/1967 | Fleck et al. | 416/241 R |
| 3,598,169 | 3/1969 | Copley | 164/60 |
| 3,700,023 | 10/1972 | Giamei et al. | 164/60 |
| 3,730,644 | 5/1973 | Jubb | 416/241 UX |
| 3,790,303 | 2/1974 | Endres | 416/241 R |
| 3,897,815 | 8/1975 | Smashey | 164/127 |
| 3,915,761 | 10/1975 | Tschinkel et al. | 148/32 |
| 3,927,952 | 12/1975 | Kirby | 416/181 X |
| 3,939,895 | 2/1976 | Sawyer | 164/60 |
| 3,940,268 | 2/1976 | Catlin | 75/208 R |
| 4,063,939 | 12/1977 | Weaver et al. | 75/208 R |
| 4,096,615 | 6/1978 | Cross | 29/156.8 R |
| 4,097,276 | 6/1978 | Six | 75/208 R |
| 4,152,816 | 5/1979 | Ewing et al. | 416/185 |
| 4,184,900 | 1/1980 | Erickson et al. | 148/32 |
| 4,186,473 | 2/1980 | Cross et al. | 29/156.8 R |
| 4,190,094 | 2/1980 | Giamei | 164/60 |
| 4,240,495 | 12/1980 | Vonnegut | 164/125 |
| 4,335,997 | 6/1982 | Ewing et al. | 29/158.8 R |

*Primary Examiner*—Robert E. Garrett
*Assistant Examiner*—Joseph M. Pitko
*Attorney, Agent, or Firm*—Terry L. Miller; Albert J. Miller

[57] ABSTRACT

A dual alloy radial turbine rotor with high tensile strength hub material exposed in the saddle regions between the blades to prevent fatigue that causes cracks in the saddle regions is manufactured by producing the hub with additional material at the outer portions of a frustoconical rear portion of the hub. After diffusion bonding of the outer surface of the hub to the mating inner surface of the blade rim, portions of the blade rim in the saddle regions are machined away to produce finished saddle configurations with the high tensile strength hub material exposed.

24 Claims, 5 Drawing Figures

DUAL ALLOY RADIAL TURBINE ROTOR WITH HUB MATERIAL EXPOSED IN SADDLE REGIONS OF BLADE RING

BACKGROUND OF THE INVENTION

Radial turbine rotors used in gas turbine engines are subjected to very high temperatures, severe thermal gradients, and very high centrifugal forces. The turbine blades are located directly in and are directly exposed to the hot gas-stream. The inducer tips of the blades therefore experience the highest temperatures and consequently are most susceptible to creep rupture failure that could result in an inducer tip striking the surrounding nozzle enclosure, causing destruction of the turbine. The turbine hub is subjected to very high radial tensile forces and also is susceptible to low-cycle fatigue damage. In order to achieve optimum blade and hub material properties, dual alloy structures have been used in which the hub is formed of wrought superalloy material having high tensile strength and high low-cycle fatigue strength, while the blade ring, including the blades (i.e., air foils) and blade rim, is formed of superalloy material having high creep rupture strength at very high temperatures. The dual alloy approach has been used where very high performance turbine rotors are required, because in very high performance turbine rotors, materials that have optimum properties for the turbine blades do not have sufficiently high tensile strength and sufficiently high low-cycle fatigue strength for use in the turbine hubs.

U.S. Pat. No. 4,335,997 by Ewing et al. discloses a dual alloy radial turbine rotor in which a preformed hub of powdered metal is consolidated into a preform having a cylindrical nose section and an outwardly flared conical skirt. After machining, the outer surface of the hub is diffusion bonded (by hot isostatic pressing) to a cast blade ring. The slope of a flared skirt portion of the blade ring is configured to optimize the location of the high strength material and achieve optimum blade and hub stress levels.

Although not recognized by the Ewing et al. reference, a problem that occurs in radial turbine rotors, is the occurrence of cracking in the "saddle" regions of the rim of the blade ring. Our analyses and experiments have shown that high creep rupture strength material of which the blade ring is formed does not adequately resist fatigue in the saddle regions at the outer portions of the conical skirt of the rim of the blade ring.

The blades in the Ewing et al. reference have cooling passages therein, resulting in a considerably lower temperature profile than would be the case for a non-cooled blade structure. Therefore, the creep rupture strength of the blade material could be lower for the Ewing et al. blade structure than for a non-cooled blade structure in the same environment. However, cooled blades are much more expensive to manufacture than non-cooled blades. It would be desirable to provide a non-cooled blade having a grain structure or morphology that can withstand failure due to creep rupture. It is also desirable that a non-cooled blade structure be provided in a radial turbine rotor that is resistant to fatigue and cracking in the saddle regions between the blades.

Numerous prior art references disclose axial dual alloy turbine wheels, but none of them are subjected to the hot radial gas flow patterns that result in cracking in the saddle regions of radial turbine rotors as described above.

Therefore, it is clear that there is an unmet need for a low cost dual alloy radial turbine rotor that avoids fatigue in the saddle regions between blades.

There is also an unmet need for a dual alloy radial turbine rotor that has non-cooled blades and is as resistant to creep rupture failure as a cooled turbine rotor subjected to the same temperatures.

SUMMARY OF THE INVENTION

Accordingly, it is an object of the invention to provide an inexpensive dual alloy radial turbine rotor that avoids fatigue and cracking in the saddle regions between the rotor blades, especially in the outer portions of the conical section of the blade ring.

It is another object of the invention to provide a low cost dual alloy radial turbine rotor that is uncooled but nevertheless has blades, the inducer tips of which are resistant to creep rupture failure up to approximately 2000 degrees Fahrenheit.

Briefly described, and in accordance with one embodiment thereof, the invention provides a radial flow turbine rotor that includes blade ring of first superalloy material having high creep rupture strength and a hub of second superalloy material having high tensile strength and high low-cycle fatigue strength, the blade ring including a rim having an inner hub-receiving surface that defines a cylindrical nose region and an enlarged conical rear section and a plurality of thin blades projecting radially outwardly from the rim and separated by saddle regions, the hub including a cylindrical nose portion and an enlarged conical rear section that mates with the inner surface of the nose portion and conical portion of the rim of the blade ring and is diffusion bonded thereto, with portions of the conical portion of the rim of the blade ring tapering to zero thickness (as a result of final machining) to expose material of the hub in the saddle regions. The radial flow turbine rotor is constructed with enough additional material on the outer portions of the conical section of the hub to increase its diameter thereat into the saddle regions. After diffusion bonding of the hub to the inner surface of the rim of the blade ring (by hot isostatic pressing), portions of the rim of the blade ring in the saddle regions are machined away to expose the hub material, which has much higher tensile strength and much higher low-cycle fatigue strength and is more resistant to fatigue and cracking in the saddle regions than is the material of the blade ring.

In one described embodiment of the invention, the hub is formed from preconsolidated nickel-base superalloy powder metal. The blade ring is cast from nickel-base superalloy material in a process that produces a radially directionally oriented grain structure at the inducer tip portions of the blades. The midspan portions of the blades and the rim of the blade ring are of fine grain structure. A medium equiaxed grain structure is provided in a transition region between the directionally oriented portions and the fine grain portions of the blade.

DESCRIPTION OF THE PREFERRED EMBODIMENT OF THE INVENTION

Figure 3:
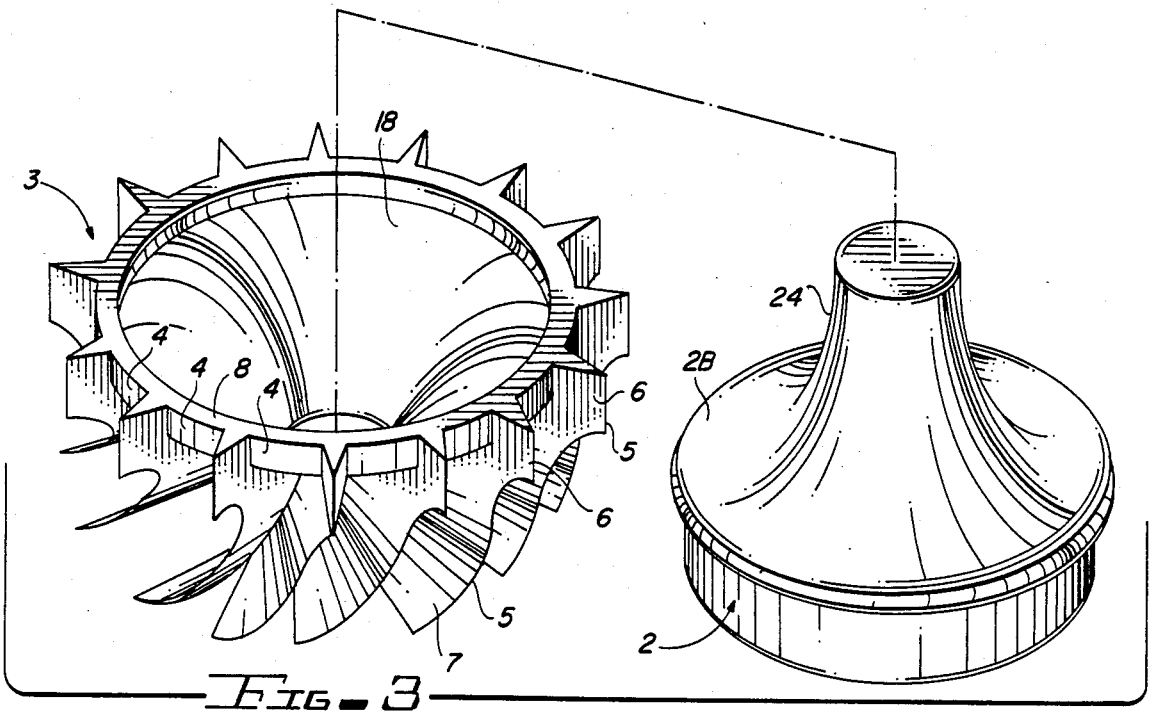
FIG. 3 is a perspective view illustrating the configurations of the hub and blade ring of the radial turbine rotor prior to assembly thereof.

Referring now to the drawings, radial flow turbine wheel 1 includes two sections, including a hub 2 which fits into and is diffusion bonded to the inner surface of a cast cored radial blade ring 3, as best seen in FIG. 3. Hub 2 has a generally cylindrical nose section 2A and a generally conical or frustoconical rear section 2B that fit into and precisely mates with an inner surface 18 of blade ring 3. An axial hole or opening 11 in hub 2 provides stress relief and reduces weight of the hub.

Blade ring 3 includes a rim 8, the smooth inner surface 18 of which mates with the outer surface of nose section 2A and conical section 2B of hub 2. A plurality of radially extending blades 5 extend outwardly from the outer surface of rim 8. Each of the turbine blades 5 includes an outermost inducer blade tip 6 aligned with the largest diamater portion of rim 8, and an exducer portion 7 extending outwardly from the smaller diameter portion of rim 8.

The turbine blades 5 define saddle regions 4 extending axially and circumferentially adjacent to the intersections of the blades 5 with the remainder of the blade ring 3. That is, the blades 5 are separated from one another by the saddle regions 4 defined therebetween.

The hub 2 is subjected to very high centrifugal forces and relatively high temperatures during operation and therefore must have high tensile strength and high low-cycle strength. Accordingly, hub 2 is typically formed from high strength Astroloy powder metal to provide increased over speed burst margin as well as increased low-cycle fatigue life. The powder metal hub can be produced by preconsolidation into near net shape by Universal Cyclops Specialty Steel Division, Inc. of Bridgeville, Pa., using its consolidation at atmospheric (CAP) pressure process.

The slope of the conical portion of hub 2, i.e., the slope of the joint at surface 18 (FIG. 2) between the material of rim 8 and the material of hub 2 is selected to provide optimum location of the high tensile strength hub material in the saddle regions 4. The inner surface 18 of rim 8 and the outer surface of the nose and conical sections 2A and 2B of hub 2 are finished to a smoothness of approximately 40 RMS (root mean square average of surface deviations in microinches).

The above-mentioned high strength Astrology powder metal material is a nickel-base superalloy material that is made by various vendors, such as Special Metals Corporation, and has been used for construction of a prototype embodiment of the invention. However, other high temperature disk materials, such as RENE 95 or UDIMET 720 can be used. Other suitable materials are being rapidly developed in the industry. Superalloy materials other than nickel-base superalloys also can be used under certain circumstances.

The need for the 40 RMS or better surface finish is to provide adequate diffusion bonding of the hub to the blade ring by means of conventional hot isostatic pressing techniques, which are well-known to those skilled in the art.

Figure 4:
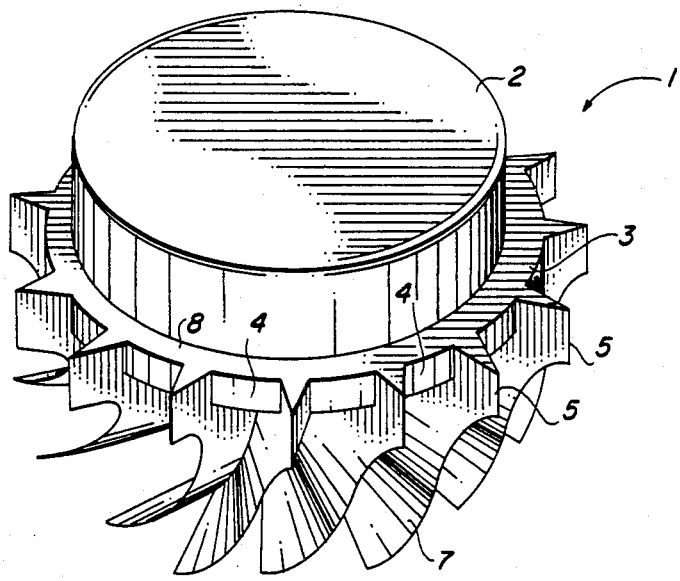
FIG. 4 is a perspective view illustrating the configuration of the radial flow turbine rotor after diffusion bonding of the hub to the rim of the blade ring.

In the drawings, reference numeral 4 indicates saddle regions disposed between the inducer portions 6 of each of the turbine blades 5, around the rim 8. As previously mentioned, cracking due to fatigue in the saddle region is a problem of the prior art which has not been adequately solved until the present invention. In accordance with one aspect of the present invention, it will be helpful to refer to FIG. 1, which is a section view of the assembled, partially completed radial turbine rotor as shown in FIG. 4. As above, reference numeral 8 designates the rim of blade ring 3. Dotted line 10 defines the final configuration of the portion of the hub material that is visible in the saddle regions after predetermined amounts of the rim 8 designated by reference numerals 8A have been machined away. Such machining exposes material of section 2B of hub 2 in the saddle regions 4, and also exposes small amounts 22 (designated by fine cross hatching in FIG. 1) of the hub material.

Figure 1:
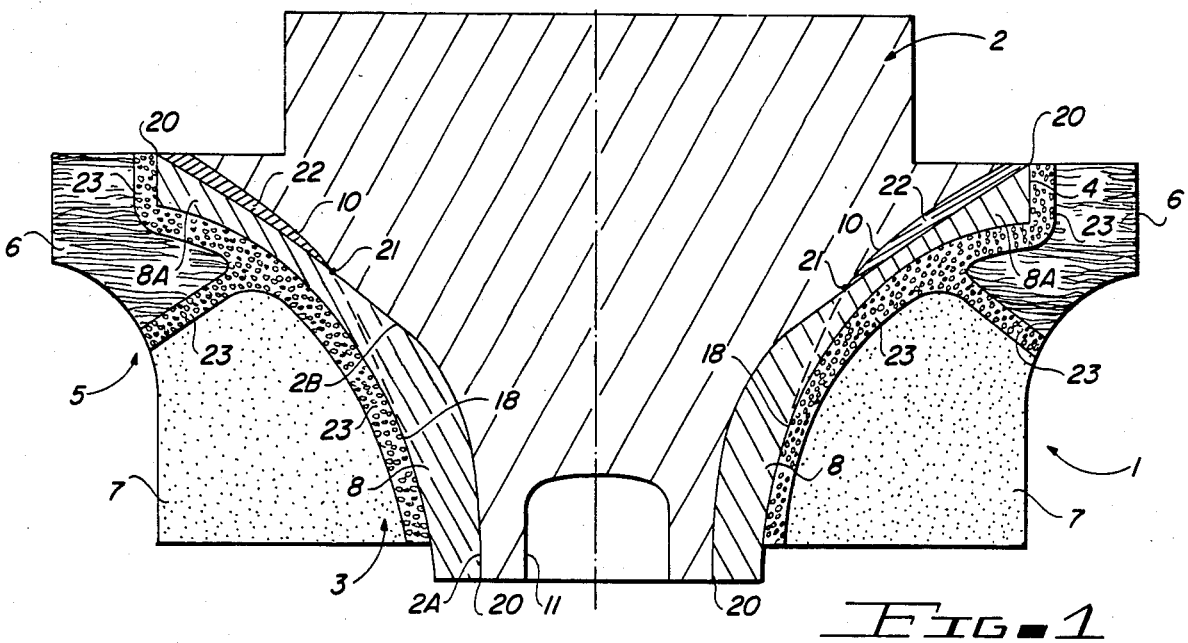
FIG. 1 is a section view diagram illustrating an embodiment of the present invention prior to machining which exposes wrought hub material in the saddle regions between rotor blades, and having a portion broken away for convenience of illustration.

In order to obtain the structure shown in FIG. 1, suitable sealing rings (not shown) or grooves (also not shown), into which alloy beads are formed, are provided to seal the terminations 20 of the joint at surface 18 between blade section 3 and hub 2 before the hot isostatic pressing process is performed. This is a conventional sealing technique, so its details are not set forth. The hot isostatic pressing process forms a high integrity diffusion bond between hub 2 and blade ring 3 along the entire length of the bond line. Conventional cleaning steps are, of course, performed prior to assembly, braze sealing, and the hot isostatic pressing process. The details of the entire hot isostatic pressing process (HIP) and techniques for sealing the end terminations of the bond joint 18 are well-known to those skilled in the art, and therefore are not set forth. Numerous corporations commercially provide hot isostatic pressing services.

Figure 2:
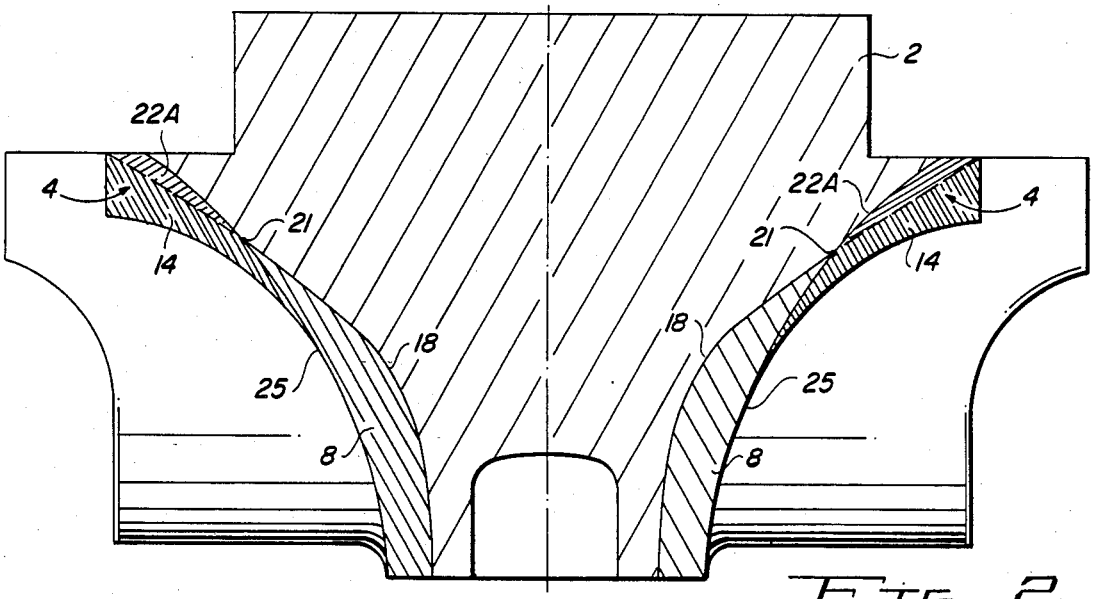
FIG. 2 is a section view diagram illustrating the structure of FIG. 1 after machining that exposes hub material in the saddle regions, in accordance with the present invention.

In accordance with one aspect of the present invention, after the HIP process is completed and suitable heat treatment steps have been performed to optimize the properties of both the material of the blade section and the material of the hub, material of rim 8 in the saddle regions is machined out, causing the thickness of rim 8 to taper down to zero at the points designated by reference numerals 21 in FIGS. 1 and 2. That is, the surplus rim material designated by reference numeral 8A in FIG. 1 is machined away. A small amount of the hub material designated by reference numeral 22 in FIG. 1 also is machined away to provide a structure in which the exposed material located at the surface of the saddle regions and radially inward of the inducer tips 6 is the high tensile strength, high low-cycle fatigue powder metal Astroloy material from which the hub 2 is formed.

The final configuration of the saddle regions is best explained with reference to FIG. 2, in which reference numeral 25 designates the final contour of the saddle regions 4, including the portions in which the powder metal of hub 2 is exposed. Reference numerals 14 in FIGS. 2 and 5 designate portions of the blade material having a machined surface area as a result of the above-mentioned machining step. Reference numerals 22A in FIG. 2 designates exposed powder metal of the hub 2 in the saddle regions 4. The path of the upper part of surface line 25 in FIG. 2 coincides with the path of dotted machine line 10 in FIG. 1. (Note that in FIG. 5, reference numeral 4' designates a saddle region which is only partially machined away, to the extent indicated by lines 4C. Dotted lines 8A indicated the original outer boundary of rim 8 in FIG. 5, before the machining down to lines 4C has been performed).

Figure 5:
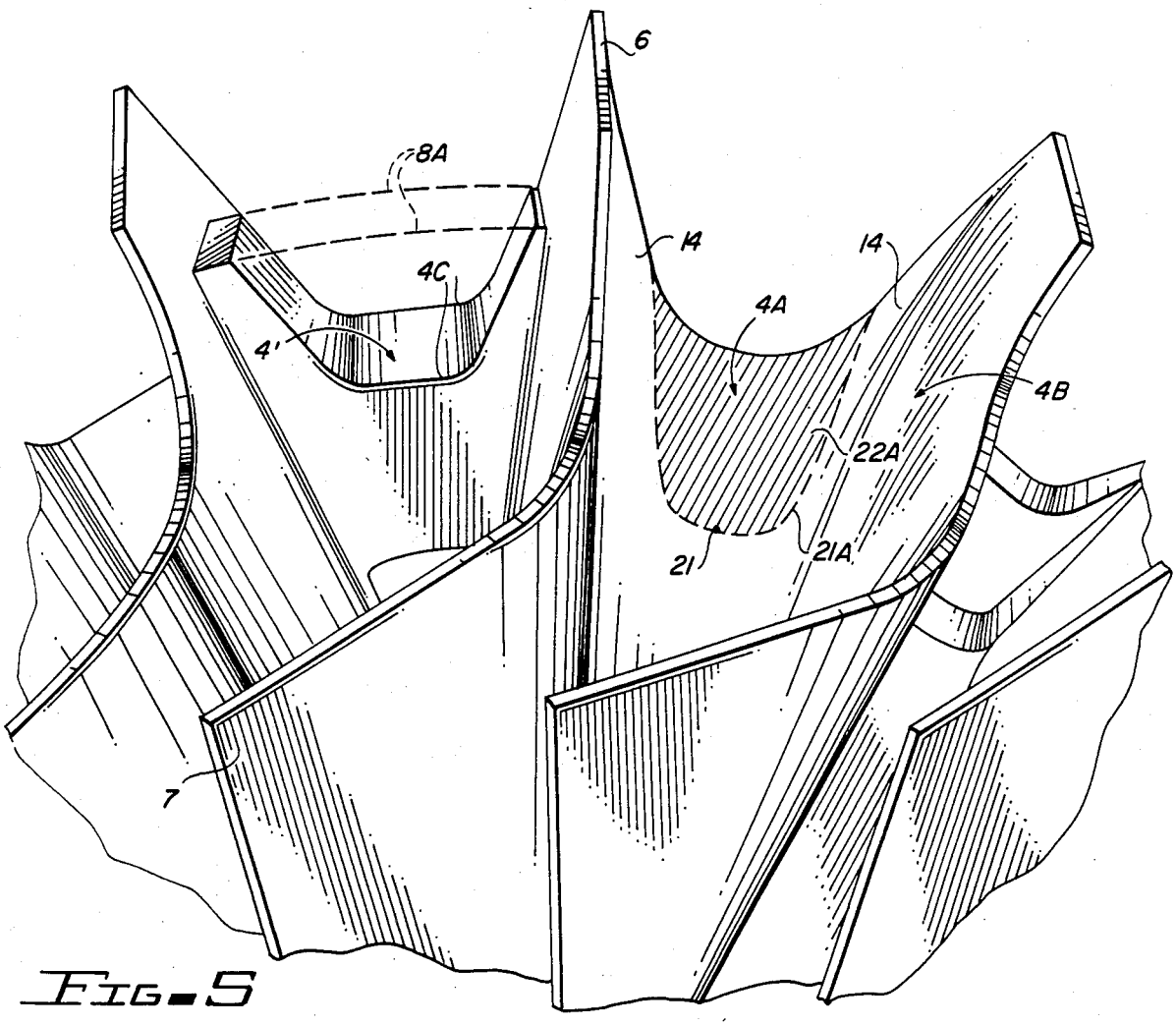
FIG. 5 is a partial perspective view illustrating a machined out saddle region exposing hub material in accordance with the present invention.

In FIG. 5, reference numeral 4A designates a completely machined out saddle region. The exposed powder metal hub material is designated by numeral 22A, as in FIG. 2. Dotted line 21A designates the boundary between exposed powder metal hub material 22A and the cast material of the blade ring. Point 21 in FIG. 5 is the same as points 21 in FIGS. 1 and 2.

The material designated by reference numeral 8A in FIG. 1 corresponds to "additional" material that is provided in rim 8 around the outermost portions of conical section 2B of hub 2 (when rim 8 is initially formed) so that the above-mentioned machining process of the present invention can be performed to remove the portions 8A of the rim material and thereby expose the powder metal hub material in the saddle regions 4.

It should be noted that it would not be feasible to simply form the blade ring 4 with cut-away openings through which the powder metal hub conical section 2B would be exposed, because as a practical matter, an adequate diffusion bonded joint could not be obtained between the blade ring material and hub material along the lines designated by reference numeral 21A in FIG. 5 by performing the above described procedures and then machining away the excess rim material.

In accordance with another aspect of the present invention, a morphology of the turbine blades 5 is produced during the casting of blade section 3 such that the inducer tip portions 6 thereof have long, directionally solidified radial grains that provide high creep rupture strength up to approximately 2000 degrees Fahrenheit. Reference numeral 23 designates a transition region in which medium equiaxed grain structures are provided in the MAR-M247 superalloy material of which blade section 3 is cast. The midspan portion and the exducer portion 7 of each of the blades 5 is composed of fine grain superalloy material, which has good thermal fatigue properties and provides adequate high cycle fatigue strength to withstand vibration-caused stresses therein during turbine operation.

The medium equiaxed grain structure 23 is provided between the base or "root" of the blades and the inducer portions 6 and exducer portions 7 in order to prevent cracks which may initiate in the high temperature, high stress, directionally solidified inducer tips 6 from propagating to the rim 8.

Thus, and in accordance with the present invention, the directionally solidified grain structure at the inducer blade tips provides extremely high creep resistance at temperatures up to 2000 degrees Fahrenheit. The fine to medium equiaxed grains in the transition regions 23 along the hub line, coupled with the powder metal Astroloy material exposed in the saddle regions of the final structure, provide high thermal fatigue resistance in the saddle region and prevent cracking therein, and the fine grain structure in the rest of the blade ring 3 provides the needed thermal fatigue properties and high low-cycle fatigue strength. However, it should be noted that an alternate grain morphology that is acceptable could include a uniformly fine grain structure throughout the casting of the blade ring 3. A particular fine grain casting that can be used is one marketed under the trademark GRAINEX, developed by Howmet Turbine Components Corporation of LaPorte, Ind.

After the hot isostatic pressing operation (which typically might be performed at 1975 to 2300 degrees Fahrenheit at 15,000 to 22,000 pounds per square inch for one to three hours in an argon atmosphere in a suitable HIP (hot isostatic pressing) autoclave to effect solid state diffusion bonding between the hub and the blade ring), various heat treatments can be provided to optimize the mechanical properties of the blade material and the hub material. For example, we performed a heat treatment wherein turbine rotor is heated to 1900 to 2300 degrees Fahrenheit in a vacuum or in argon for two to four hours, and rapidly quenched with gas to below approximately 1800 degrees Fahrenheit at a rate greater than 100 degrees Fahrenheit per minute, and is further quenched to 1200 degrees Fahrenheit at a rate greater than 75 degrees Fahrenheit per minute.

The turbine rotor then is aged for six to eight hours in an air or a mixure of air and argon at a temperature in the range from 1500 to 1700 degrees Fahrenheit, and then cooled in air to room temperature.

This is followed by aging for two to four hours in air or a mixture of air and argon at a temperature in the range of 1600 to 1800 degrees Fahrenheit, and air cooling to room temperature. Then the turbine rotor is aged for 20 to 24 hours in air or air and argon at a temperature in the range of 1000 to 1200 degrees Fahrenheit, and air cooled to room temperature. Finally, the rotor is aged for six to eight hours in air or argon at 1200 to 1400 degress Fahrenheit and air cooled to room temperature. It should be appreciated that vendors in the industry can provide various heat treating sequences to optimize certain properties of such metal dual alloy turbine rotors. The cast grain structure shown in FIG. 1 was formed of MAR-M247 material by Hownet Turbine Components, LaPorte, Ind., after we provided them with a description of the desired above described grain structure morphology for blade ring 3.

The above described radial flow turbine rotor provides a very high performance, relatively low cost structure having extremely high material strengths optimized in both the hub and the blade section, and avoids the problem of thermal fatigue in the saddle regions between the blades without incurring the additional costs associated with providing a cooled blade structure. However, the described structure could be provided for a radial turbine rotor with a cooled blade structure of the type disclosed in the above referenced U.S. Pat. No. 4,335,997 to achieve even higher temperature performance.

While the invention has been described with reference to a particular embodiment thereof, those skilled in the art will be able to make various modifications to the described embodiment without departing from the true spirit and scope of the invention. It is intended that elements and steps that are equivalent to those described herein in that they perform substantially the same function in substantially the same way to achieve substantially the same result are to be encompassed within the invention. For example, the blade ring can be cast in such a manner that a single crystal structure is produced in the inducer portions of each of the blades, rather than a directionally solidified grain structure.

We claim:

1. A radial flow turbine rotor comprising:

(a) a blade ring of first superalloy material having high creep rupture strength and including a rim having an inner hub-receiving surface that defines a generally cylindrical nose region and an enlarged generally frustoconical rear region, said blade ring also including a plurality of thin blades extending outwardly from said rim and defining saddle regions therebetween, each of the saddle regions being disposed directly between and bounded by a pair of the thin blades;

(b) a central hub of second superalloy material having high tensile strength and high low-cycle fatigue strength and including a generally cylindrical nose portion and an enlarged generally frustoconcial rear portion disposed in said nose region and said rear region, respectively, and diffusion bonded to said hub-receiving surface, portions of said frustoconical rear portion of said hub being exposed in said saddle regions to thereby expose the high tensile strength, high low-cycle fatigue strength material of said hub in said saddle regions in order to reduce effects of thermal fatigue that may lead to cracking in said saddle region.

2. The radial flow turbine rotor of claim 1 wherein the thickness of a portion of said rim tapers from a predetermined thickness around said cylindrical nose region to zero thickness along a boundary between the material of said rim and said exposed portions of said hub.

3. The radial flow turbine rotor of claim 2 wherein said plurality of thin blades are non-cooled.

4. The radial flow turbine rotor of claim 2 wherein an outer inducer portion of each of said blades is composed of radially directionally solidified material.

5. The radial flow turbine rotor of claim 4 wherein an exducer portion of each of said blades is composed of fine grain material.

6. The radial flow turbine rotor of claim 5 wherein each of said blades includes a transition region composed of medium equiaxed grain material located between the directionally solidified portions and the fine grain portions of that blade and the base of said blade ring to prevent cracks that may initiate in said directionally solidified portions from propagating to said rim.

7. The radial flow turbine rotor of claim 2 wherein said blade ring of said turbine rotor is composed entirely of fine grain material.

8. The radial flow turbine rotor of claim 2 wherein said hub is composed of high strength Astroloy powder metal.

9. The radial flow tubine rotor of claim 8 wherein said blade ring is composed of cast nickel based superalloy material.

10. The radial flow turbine rotor of claim 9 wherein said first superalloy material has high creep rupture strength up to approximately 2000 degrees Fahrenheit and said second superalloy material has high tensile strength and high low cycle fatigue strength up to approximately 1400 degrees Fahreinheit.

11. The radial flow turbine rotor of claim 8 wherein the material of said hub is exposed in the central uppermost portion of said saddle regions.

12. A radial flow turbine rotor comprising:

(a) a blade ring of first superalloy material and including a rim having a hub-receiving surface that defines a generally cylindrical nose region and a generally conical rear region, said blade ring including a plurality of blades extending from said rim and defining saddle regions therebetween, each of the saddle regions being disposed directly between and bounded by a pair of the thin blades;

(b) a hub of second superalloy material having high tensile strength and including a generally cylindrical nose portion and a generally conical rear portion disposed in said nose region and said rear region, respectively, and diffusion bonded to said hub-receiving surface, portions of said rear portion of said hub being exposed in said saddle regions to provide high tensile strength material of said hub in said saddle regions.

13. The radial flow turbine rotor of claim 12 wherein the thickness of a portion of said rim tapers from a predetermined thickness around said nose region to zero thickness along a boundary between the material of said rim and said portions of said hub exposed in one of said saddle regions.

14. The radial flow turbine rotor of claim 13 wherein an outer inducer portion of each of said blades is composed of radially directionally solidified material.

15. The radial flow turbine rotor of claim 14 wherein said first superalloy material is cast material having high creep rupture strength up to approximately 2000 degrees Fahrenheit and said second superalloy material is wrought material having high tensile strength and high low-cycle fatigue strength up to approximately 1400 degrees Fahreinheit.

16. A radial flow turbine rotor comprising:

(a) a blade ring cast of first superalloy material having high creep rupture strength up to approximately 2000 degrees Fahrenheit and including a rim having an inner hub receiving surface that defines a generally cylindrical nose region and an enlarged generally frustoconical rear region, said blade ring also including a plurality of thin blades extending outwardly from said rim and defining saddle regions therebetween; and (b) a central hub wrought of second superalloy material having high tensile strength and high low-cycle fatigue strength up to approximately 1400 degrees Fahrenheit and including a generally cylindrical nose portion and an enlarged generally frustoconical rear portion disposed in said nose region and said rear region, respectively, and diffusion bonded to said hub-receiving surface, portions of said frustoconical rear portion of said hub being exposed at locations of central uppermost portions of said saddle regions, thereby providing the high tensile strength, high low-cycle fatigue strength material of said hub at the surfaces in said saddle regions and thereby reducing effects of fatigue that may lead to cracking in said saddle regions, the thickness of a portion of said blade ring tapering from a predetermined thickness around said nose region to zero thickness along a boundary between the material of said rim and said exposed portion of said hub.

17. A method of manufacturing a radial flow turbine rotor, said method comprising the steps of:

(a) providing a blade ring of first superalloy material having high creep rupture strength up to a first predetermined temperature, said blade ring including a rim having an inner surface that defines a cylindrical nose region and an enlarged, frustoconical rear region, said blade ring also including a plurality of thin blades extending outwardly from said rim and defining saddle regions between the outer portions of said blade ring around said frustoconical rear region;

(b) providing a central hub of second superalloy material having high tensile strength and high low-cycle fatigue strength up to a second predetermined temperature, said central hub having a cylindrical nose portion and an enlarged, frustoconical rear portion extending from said nose portion;

(c) inserting said hub into said blade ring, said cylindrical nose portion and said frustoconical rear portion of said hub fitting precisely into said cylindrical nose region and said frustoconical rear region, respectively;

(d) diffusion bonding said hub and said blade ring together by hot isostatic pressing;

(e) machining away portions of said rim in said saddle regions to expose portions of said hub, whereby said radial flow turbine rotor has exposed high tensile strength, high low-cycle fatigue strength material in said saddle regions to reduce fatigue that leads to cracking in said saddle regions.

18. The method of claim 17 wherein step (b) includes providing an amount of said second superalloy material in outer portions of said frustoconical rear portion of said hub wherein a portion of said second superalloy material is to be later machined away in said saddle regions during step (e).

19. The method of claim 18 wherein step (a) includes casting said first superalloy material to produce a radially directionally solidified grain structure in the outer portions of said blades.

20. The method of claim 19 wherein step (a) includes casting said first superalloy material to produce a fine grain structure in inner portions of said blades and a medium equiaxed grain structure in a transition region between said outer portions of said blades and said inner portions of said blades.

21. The method of claim 18 including casting said first superalloy material to produce a fine grain structure throughout said blades and said blade ring.

22. The method of claim 20 including forming said hub of preconsolidated high strength Astroloy powder metal.

23. The method of claim 22 wherein said first predetermined temperature is approxmately 2000 degrees Fahrenheit and said second predetermined temperature is approximately 1400 degrees Fahrenheit.

24. A method of manufacturing a radial flow turbine rotor, said method comprising the steps of:

(a) providing a blade ring of first superalloy material having high creep rupture strength and including a rim having an inner surface that defines a nose region and an enlarged generally frustoconical rear region, said blade ring including a plurality of thin blades projecting outwardly from said rim and separated by saddle regions;

(b) providing a hub of second superalloy material having high tensile strength and having a nose portion and an enlarged, generally frustoconical rear portion;

(c) inserting said hub into said blade ring;

(d) bonding said hub and said blade portion together; and, (e) machining away portions of said blade ring in said saddle regions and exposing material of said hub, in said saddle regions, whereby said radial flow turbine rotor has high tensile strength material exposed in the surface of said saddle regions to reduce effects of fatigue that lead to cracking in said saddle regions.

* * * * *